US006648594B1

(12) United States Patent
Horner et al.

(10) Patent No.: US 6,648,594 B1
(45) Date of Patent: Nov. 18, 2003

(54) TURBOCHARGER

(75) Inventors: Brian Horner, Liverpool (GB); William Connor, Southport (GB)

(73) Assignee: Honeywell International, Inc., Morristown, NJ (US)

( * ) Notice: Subject to any disclaimer, the term of this patent is extended or adjusted under 35 U.S.C. 154(b) by 1 day.

(21) Appl. No.: 10/111,904

(22) PCT Filed: Jul. 28, 2000

(86) PCT No.: PCT/GB00/02910

§ 371 (c)(1),
(2), (4) Date: Apr. 30, 2002

(87) PCT Pub. No.: WO01/09517

PCT Pub. Date: Feb. 8, 2001

(30) Foreign Application Priority Data

Jul. 30, 1999 (GB) ..... 9918072

(51) Int. Cl.[7] ..... F04D 27/00

(52) U.S. Cl. ..... 415/145; 415/58.4; 415/144; 415/206; 417/407; 60/726

(58) Field of Search ..... 415/145, 58.4, 415/58.3, 58.2, 58.1, 52.1, 144, 206, 116, 53 R, 213 R, 119; 417/407; 60/726

(56) References Cited

U.S. PATENT DOCUMENTS

| | | | | |
|---|---|---|---|---|
| 4,743,161 A | | 5/1988 | Fisher et al. | |
| 4,886,416 A | * | 12/1989 | Wunderlich | 415/158 |
| 4,930,978 A | | 6/1990 | Khanina et al. | |
| 4,981,018 A | | 1/1991 | Jones et al. | |
| 5,380,151 A | | 1/1995 | Kosika et al. | |
| 5,855,117 A | * | 1/1999 | Sumser et al. | 60/602 |
| 5,863,178 A | * | 1/1999 | Scheinert et al. | 415/58.4 |
| 6,224,333 B1 | * | 5/2001 | Loeffler et al. | 415/158 |

FOREIGN PATENT DOCUMENTS

| | | |
|---|---|---|
| DE | 879 280 | 6/1953 |
| GB | 2 202 585 | 9/1988 |

* cited by examiner

*Primary Examiner*—Edward K. Look
*Assistant Examiner*—J. M. McAleenan
(74) *Attorney, Agent, or Firm*—Young & Thompson

(57) ABSTRACT

A turbocharger for an internal combustion engine comprises an air intake, a compressor, a compressor housing (2), a plurality of bypass channels (1) formed in the compressor housing (2) providing a short cut to air from the air intake into the turbine, and elements for controlling the extent to which the bypass channels are open, for example by a slidable or rotatable sleeve (5) having a pattern of slots (6) corresponding to the pattern of channels. This results in increased stability and overall efficiency.

13 Claims, 1 Drawing Sheet

TURBOCHARGER

FIELD OF THE INVENTION

The present invention relates to a turbocharger for at internal combustion engine, particularly variable speed engine.

It is preferable in turbochargers for variable speed engines to use a relatively wide compressor, since this gives maximum control. However, the thermodynamic efficiency of a turbocharger is generally compromised by increased compressor width. This is especially so when the turbine flow is controlled by a bypass or a variable geometric device. Currently the problem is addressed by cutting back the leading edge of alternate compressor blades to reduce inlet choking and thus increase the maximum flow potential. However the stability of such a turbocharger at low flow rates is poor and the overall efficiency decreased.

SUMMARY OF THE INVENTION

According to the present invention there is provided a turbocharger for an internal combustion engine, the turbocharger comprising an air intake, a compressor housing, a plurality of bypass channels formed in the compressor housing providing a short cut to air from the air intake through the housing, and means for controlling air flow through the bypass channels (1).

BACKGROUND OF THE INVENTION

Preferably the means for controlling air flow through the bypass channels comprises a movable sleeve having a pattern of openings, eg. slots. The pattern of slots preferably corresponds to the pattern of channels in the housing, and the sleeve is used to selectively cover the channels fully, partially or not at all depending upon the alignment of channels and openings.

According to a one embodiment the sleeve is movable axially to control the opening of the channels.

According to a second embodiment the sleeve is slidable in a rotating motion to effect control of the air flow through the channels.

The channels may be formed in a circular pattern or an axial pattern, and the slots in the sleeve will preferably correspond.

BRIEF DESCRIPTION OF THE DRAWING

For a better understanding of the present invention, and to show how the same may be carried into effect, reference will now be made, by way of example, to the single figure of the accompanying drawing which shows a cross-sectional schematic view of part of a compressor for a turbocharger according to the present invention.

DETAILED DESCRIPTION OF THE INVENTION

Figure 1:
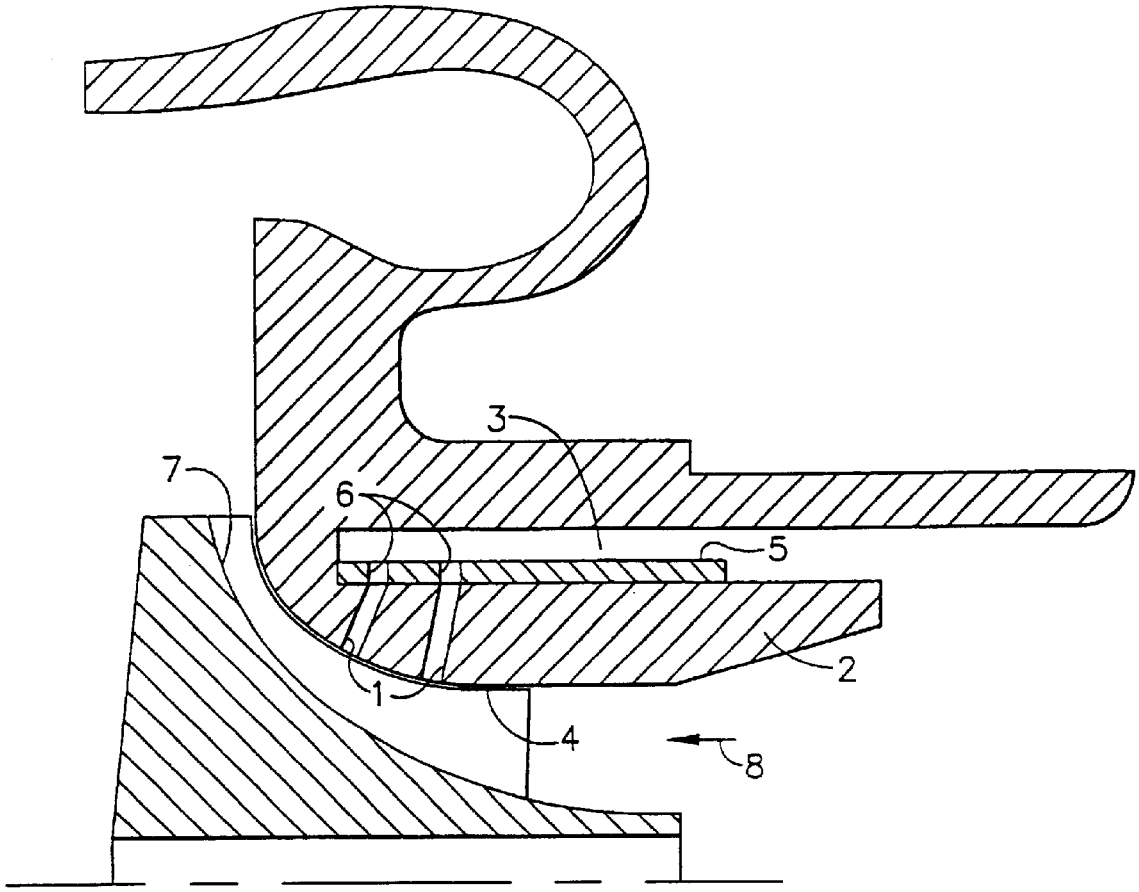

The figure shows the air inlet system to a turbocharger compressor and comprises a main air inlet 8 and a compressor housing 2 which separates an additional air intake gallery 3 through a housing shroud line 4 to a wheel 7. In the wall of the compressor housing 2 there are two bypass channels 1. The number of channels, and their positioning along the shroud line 4, can be varied; two only are shown in the figure for simplicity. The channels 1 allow air to flow from the air intake gallery 3 to the housing shroud line 4.

The flow is controlled by a valve sleeve 5 having valve ports 6 formed therein. The sleeve 5 selectively covers the channels and prevents air flow through them as required. The valve sleeve 5 is arranged to slide or rotate in such a manner as to progressively uncover more area of the channels 1, allowing air through the compressor housing 2 and into the wheel 7, or from the wheel 7 back through one housing 2 into inlet 3 as operating conditions dictate. Under low engine speeds, when low compressor flow is required, air is recirculated through the channel arrangement, to improve stability of flow (reduce compressor surge) and at high engine speeds when high compressor flow is needed, additional air enters the wheel through the channels. The sleeve position can be controlled electronically in a manner which will be evident to a person skilled in the art. A vehicle's on-board microprocessor can be suitably adapted for this purpose.

In this way the flow through a plurality of bypass channels is controlled to match the operating conditions of the engine.

The channels 1 can be arranged so that the leading channels are opened first and subsequent channels are sequentially uncovered as the valve sleeve 5 slides or rotates. Air enters the wheel 7 at various positions in the wheel depending upon the arrangement of the channels and the extent to which they are covered by the sleeve 5.

The front channel, i.e. that to the eft as shown in the figure, tends to be significant at low flow rates and influence the surge margin. The rear channel (i.e. that to the right as shown in the figure) tends to be significant at high low rates and influence the choke pressure.

The valve sleeve 5 as shown slides axially to open and close the channels 1 via the valve ports 6. However a rotating motion would be equally suitable.

The channels 1 may be formed with generally circular or elongate openings or may be fully circumferential (i.e. extend essentially completely around the valve sleeve), in which case it is of course necessary to include additional supports. The valve sleeve 5 can be axially slotted to mesh with such supports, for sliding axially to open and close the bypass channels 1.

In one embodiment, the channels 1 extend only over a portion of the circumference, for example over a 45 degree portion of every quarter of the circumference. The pattern of valve ports 6 on the sleeve 5 is arranged to match the pattern of channels 1 in the compressor housing 2. Hence in this example the valve ports 6 would also comprise, at each axial position, four equidistantly spaced slots each extending over about 45 degrees of the circumference. The angles are preferably modified to match the number of channels and provide progressive opening of the different channels.

The channels 1 in the compressor housing 2 may be perpendicular to the axis of the compressor housing 2, or they may subtend an acute angle, i.e. less than 90°, to the axis.

What is claimed is:

1. A turbocharger for an internal combustion engine, he turbocharger comprising an air intake (8), a compressor housing (2), a plurality of bypass channels (1) formed in the compressor housing (2) providing a short cut to air from the air intake (8) through the housing 2) and means or controlling air flow through the bypass channels (1).

2. A turbocharger according to claim 1 wherein the means for controlling air flow through the repass channels (1) comprises a movable sleeve (5) having a pattern of openings (6).

3. A turbocharger according to claim 2 wherein the pattern of openings (6) in the sleave (5) corresponds to the pattern of channels (1) in the housing (2).

4. A turbo charger according to claim 1, wherein the sleeve (5) is movable axially to control air flow through the channels (1).

5. A turbocharger according to claim 1, wherein the sleeve (5) is slidable in a rotating motion to effect control of air flow through the channels (1).

6. A turbocharger according to claim 1 wherein the channels (1) are formed in a circular pattern.

7. A turbocharger according to claim 1 wherein the channels (1) are formed in an axial pattern.

8. A turbocharger according to claim 1 wherein the air flow control means (5) is operated electronically, under control of a microprocessor to match the operating conditions of the vehicle engine.

9. A turbocharger according to claim 1 wherein the channels (1) are arranged so that the leading channel is opened first and the or each other channels are opened in sequence.

10. A turbocharger according to claim 1 wherein the channels (1) are formed with generally circular openings.

11. A turbocharger according to claim 1 wherein the channels (1) are formed with generally elongated openings.

12. A turbocharger according to claim 1 wherein the channels (1) are circumferential.

13. A turbocharger according to claim 1 wherein the channels (1) subtend an acute angle to the axis of the compressor housing (2).

* * * * *

UNITED STATES PATENT AND TRADEMARK OFFICE

CERTIFICATE OF CORRECTION

PATENT NO. : 6,648,594 B1
DATED : November 18, 2003
INVENTOR(S) : Horner et al.

It is certified that error appears in the above-identified patent and that said Letters Patent is hereby corrected as shown below:

Column 2,
Line 62, “repass” should read -- bypass --

Signed and Sealed this

Sixteenth Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,648,594 B1
DATED : November 18, 2003
INVENTOR(S) : Brian Horner and William Connor It is certified that error appears in the above-identified patent and that said Letters Patent is hereby corrected as shown below:

Column 2,
Line 66, replace “sleave” with -- sleeve --

Signed and Sealed this

Twentieth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,648,594 B1
DATED : November 18, 2003
INVENTOR(S) : Brian Horner and William Connor It is certified that error appears in the above-identified patent and that said Letters Patent is hereby corrected as shown below:

Column 1,
Line 6, replace “at” with -- an --
Line 7, add “for” after -- particularly --

Column 2,
Line 25, replace “eft” with -- left --
Line 28, replace “low” with -- flow --
Line 55, replace “he” with -- the --
Line 59, replace “or” with -- for --

Column 3,
Line 1, replace “turbo charger” with -- turbocharger --

Signed and Sealed this

Twelfth Day of October, 2004

JON W. DUDAS
*Director of the United States Patent and Trademark Office*